US011891922B2

(12) United States Patent
Chaix et al.

(10) Patent No.: US 11,891,922 B2
(45) Date of Patent: Feb. 6, 2024

(54) METHOD AND DEVICE FOR CONVERTING THERMAL ENERGY

(71) Applicant: Hevatech, Saint-Paul-Trois-Châteaux (FR)

(72) Inventors: Jean-Edmond Chaix, Pierrevert (FR); Patrick Bouchard, La Bastidonne (FR); Guillaume Le Guen, Saint Paul Trois Chateaux (FR)

(73) Assignee: Hevatech, Saint-Paul-Trois-Châteaux (FR)

( * ) Notice: Subject to any disclaimer, the term of this patent is extended or adjusted under 35 U.S.C. 154(b) by 310 days.

(21) Appl. No.: 17/255,997

(22) PCT Filed: Jun. 25, 2019

(86) PCT No.: PCT/FR2019/051550

§ 371 (c)(1),
(2) Date: Dec. 23, 2020

(87) PCT Pub. No.: WO2020/002818

PCT Pub. Date: Jan. 2, 2020

(65) Prior Publication Data

US 2021/0222590 A1 Jul. 22, 2021

(30) Foreign Application Priority Data

Jun. 28, 2018 (FR) ..... 1855910

(51) Int. Cl.
*F01K 21/00* (2006.01)
*F01K 1/00* (2006.01)
(Continued)

(52) U.S. Cl.
CPC ..... *F01K 21/005* (2013.01); *F01K 1/00* (2013.01); *F01K 3/186* (2013.01); *F01K 25/04* (2013.01); *F01K 25/065* (2013.01); *F22B 1/006* (2013.01)

(58) Field of Classification Search
CPC ..... F01K 21/005; F01K 1/00; F01K 3/186; F01K 25/04; F01K 25/065; F22B 1/006;
(Continued)

(56) References Cited

U.S. PATENT DOCUMENTS 3,972,195 A 8/1976 Hays et al.
3,995,428 A 12/1976 Roberts
(Continued)

FOREIGN PATENT DOCUMENTS

DE 2148027 4/1972

*Primary Examiner* — Wesley G Harris
(74) *Attorney, Agent, or Firm* — Meunier Carlin & Curfman LLC

(57) ABSTRACT

An improved efficiency method and device for converting thermal energy into mechanical energy, and then, preferably, into electricity and/or refrigerating energy. A partially liquid stream $f^{c0}$ of fluid FC is implemented; thermal energy is transferred to the stream $f^{c0}$; the heated stream $f^{c0}$ is sprayed to generate a fragmented stream $f^{c1}$ of fluid FC. Simultaneously a partially liquid stream $f^{t0}$ of fluid FT is implemented; thermal energy is transferred to the stream $f^{t0}$ to generate a stream $f^{t}$ that may be in liquid form or a saturated liquid/vapor mixture; stream $f^{1}$ is expanded in a chamber which also receives fragmented stream $f^{c1}$ to form a two-phase mixed stream $f^{c1/t}$ whose kinetic energy is converted into mechanical energy which is optionally transformed into electrical energy or into refrigerating energy.

18 Claims, 5 Drawing Sheets

(51) Int. Cl.

| | |
|---|---|
| ***F01K 3/18*** | (2006.01) |
| ***F01K 25/06*** | (2006.01) |
| ***F01K 25/04*** | (2006.01) |
| *F22B 1/00* | (2006.01) |

(58) Field of Classification Search
CPC .. B04B 5/005; B04B 9/06; B04B 5/12; B04B 1/08; F01M 2013/0422; B01D 45/14
USPC ..... 494/49; 55/406, 407, 404
See application file for complete search history.

(56) References Cited

U.S. PATENT DOCUMENTS

| | | | | |
|---|---|---|---|---|
| 4,106,294 | A * | 8/1978 | Czaja | F01K 21/04 60/649 |
| 9,644,615 | B2 | 5/2017 | Chaix | |
| 2012/0006024 | A1 * | 1/2012 | Hays | F01K 25/065 60/692 |
| 2013/0276447 | A1 | 10/2013 | Chaix | |
| 2013/0340434 | A1 * | 12/2013 | Palmer | F01K 19/04 60/676 |

* cited by examiner

METHOD AND DEVICE FOR CONVERTING THERMAL ENERGY

TECHNICAL FIELD

The field of the invention is that of the technologies for valorization of heat, in particular industrial waste heat.

The invention relates in particular to a method for converting thermal energy into mechanical energy, then, preferably, into electrical energy and/or refrigerating energy.

The invention also relates to a device for implementing this method.

STATE OF THE ART

Technical Problem

Waste heat is the residual heat originating from and not used by a process (fumes, moisture from drying, heat engine exhaust, etc.).

Sources of waste heat are very diverse. These may be power generation sites (nuclear plants), industrial production sites, tertiary buildings such as hospitals, which emit heat all the more because they consume a lot of it, transport networks in an enclosed space, or also waste disposal sites such as units for the thermal treatment of waste.

As regards industrial waste heat, the steel, chemicals, cement, agri-food or also glass sectors generate vast quantities of heat lost by release into the atmosphere.

By way of example, 36% of the fuel consumption of industry is lost in the form of heat.

Exhaust gases are another source of waste heat.

Waste heat represents a resource of approximately 50% of global energy consumption, taking all sectors together.

European Directive 2012/27/EU on energy efficiency requires emitters of waste heat situated close to a heating network to carry out a cost-benefit analysis in order to investigate the possibilities for valorization of waste heat. If the solution is considered to be cost-effective, it must be implemented. Similarly, all heating network projects must also assess the various potential avenues for recovery of waste heat.

In this context, patent application WO2012089940A2 describes a device for converting thermal energy into mechanical energy including:

- a first-fluid feed line,
- a heat-transfer fluid feed line,
- a steam generator equipped with:
  - a first inlet connected to the supply line of the first fluid, the first fluid taking a first path between the first inlet and a first outlet,
  - a second inlet receiving the heat-transfer fluid, the heat-transfer fluid taking a second path between the second inlet and a second outlet, the second path being different from the first path, the first path being thermally coupled to the second path, so as to form vapour from the first fluid, said vapour leaving the generator via the first outlet,
- a chamber equipped with:
  - a first inlet connected to the first outlet of the steam generator, the first fluid taking a first path in the chamber between the first inlet and a first outlet, the chamber being configured to produce the isothermal expansion of the first fluid in the chamber by means of a divided expansion via a plurality of elementary isothermal expansions,

- a second inlet connected to the heat-transfer fluid feed line, the heat-transfer fluid taking a second path different from the first path between the second inlet and a second outlet, the second outlet of the chamber being connected to the second inlet of the steam generator, the first path being thermally coupled to the second path so as to heat the first fluid between each expansion,
- a mixing device connected to the first outlet of the chamber and to the second outlet of the steam generator and configured so as to mix the first fluid in the form of vapour with a heat-transfer fluid in order to obtain a two-phase mixture.

The heat-transfer fluid is heated by solar energy capture means.

The heat-transfer fluid is for example oil, while the first fluid is a thermodynamic stream, for example water or a water/glycerol mixture. This two-phase mixture is a stream of heat-transfer fluid in the form of droplets of oil and of working fluid in the form of steam, at high temperature. The kinetic energy of this stream is converted to mechanical energy by means of a turbine of the Pelton type, driving an electrical alternator. The oil/water mixture is recovered on leaving the turbine and the 2 fluids are separated, then reused in this conversion of thermal energy into mechanical energy, then into electricity.

In this method and this device according to WO2012089940A2, the heat-transfer fluid is heated by a solar concentrator and then contributes to the conversion of the working fluid into vapour, then to the reheating of the working fluid between each expansion. This method and this device according to WO2012089940A2 are not specifically adapted to the conversion of the thermal energy originating from waste heat, which may have a wide temperature range, into electrical energy. Furthermore, the performance of this known method and device can be improved, in particular in terms of energy efficiency and extension of the range of the electrical power generated.

Objectives of the Invention

In this context, the present invention aims to satisfy at least one of the objectives set out below:

One of the essential objectives of the present invention is to provide an enhanced method for converting thermal energy, preferably from waste heat, into mechanical energy, and preferentially into electrical energy and/or refrigerating energy, the sought enhancement consisting of an improvement of the energy efficiency of the conversion.

One of the essential objectives of the present invention is to provide an enhanced method for converting thermal energy originating from a source of waste heat into mechanical energy, and preferentially into electrical energy and/or refrigerating energy, the sought enhancement consisting of an adaptability of the method to sources of waste heat the temperature of which varies within a wide range.

One of the essential objectives of the present invention is to provide an enhanced method for converting thermal energy, preferably from waste heat, into mechanical energy, and preferentially into electrical energy and/or refrigerating energy, which is economical in terms of production and maintenance.

One of the essential objectives of the present invention is to provide an enhanced method for converting thermal energy, preferably from waste heat, into mechanical energy, and preferentially into electrical energy and/or refrigerating energy, which is compatible with environmental constraints.

One of the essential objectives of the present invention is to provide an industrial device that is reliable, effective, economical and robust, for implementing the method as set out in one of the aforementioned objectives.

BRIEF DESCRIPTION OF THE INVENTION

These objectives, among others, are achieved by the present invention, which relates, firstly, to a method for converting thermal energy, preferably from waste heat, contained in an at least partially gaseous fluid called waste fluid (FF), into mechanical energy, and preferentially into electrical energy and/or refrigerating energy;

said method utilizing at least one working fluid FT and at least one heat-transfer fluid FC, in which:

I. a stream $f^{c0}$ of fluid FC, at least partially liquid, is utilized;

II. thermal energy to be converted, originating from the fluid FF, is transferred to the stream $f^{c0}$;

III. the stream $f^{c0}$ heated in (II) is sprayed in order to generate a fragmented stream $f^{c1}$ of fluid FC;

IV. in parallel, a stream $f^{t0}$ of fluid FT, at least partially liquid, is utilized;

V. then thermal energy to be converted, originating from the fluid FF, is transferred to the stream $f^{t0}$ of fluid FT, in order to generate a stream $f^{t}$, the temperature of which is above that of the stream $f^{t0}$, the fluid FT of the stream $f^{t}$ being:

i. in liquid phase;

ii. in liquid phase and in vapour phase;

in saturated vapour phase;

iv. or in superheated vapour phase;

VI. when required, the stream $f^{t}$ is heated to vaporize it such that the vapour titre thereof is greater than or equal to 0.9, preferably 0.95;

VII. the stream $f^{t}$ is injected into at least one container also receiving the stream $f^{c1}$ of fluid FC, in order to form a dual-phase mixed stream $f^{c1/t}$; the ratio Rd of the mass flow of the fluid FT to the total mass flow of the fluid FC and the fluid FT being comprised between 1 and 20%, preferably between 3 and 18%, and even more preferentially between 5 and 15%;

VIII. this stream $f^{c1/t}$ is then accelerated and expanded;

IX. the kinetic energy of this accelerated stream $f^{c1/t}$ is converted into mechanical energy; the latter being optionally converted into electrical energy and/or refrigerating energy;

X. FT on the one hand and FC on the other hand are separated;

XI. on the one hand, an at least partially gaseous stream $f^{t00}$ of FT and, on the other hand, an at least partially liquid stream $f^{c0}$ of FC are recovered;

XII. the stream $f^{c0}$ of FC is compressed, and the circulation speed thereof is increased;

XIII. the at least partially gaseous stream $f^{t00}$ of FT is condensed to an at least partially liquid stream $f^{t0}$ of FT;

XIV. the stream $f^{t0}$ of FT is compressed, and the circulation speed thereof is increased;

characterized in that this method comprises the implementation of at least one FT circulation loop and at least one FC circulation loop;

these two loops having in common:

i. at least one Injector-Mixer-Accelerator (IMA) in which the stream $f^{c0}$ and the stream $f^{t}$ are intended to be injected/mixed/accelerated;

ii. at least one converter of the accelerated stream $f^{c1/t}$ into mechanical energy;

iii. optionally at least one converter of this mechanical energy into electrical energy and/or refrigerating energy;

iv. at least one separator of FT and FC;

the FT circulation loop including at least one heat exchanger between FT (step V, or VI) and FF, at least one condenser of FT and at least one pump for circulating FT in this loop;

the FC circulation loop including a heat exchanger between FC (step II) and FF, and at least one pump for circulating FC in this loop.

Credit is due to the inventors for envisioning the implementation of two fluid loops: one of heat-transfer fluid and one of working fluid, each of these loops including means for circulating the fluid and means for recovering waste heat by heat exchange between the waste fluid and the heat-transfer fluid in one of the loops, or the working fluid in the other loop.

The method according to the invention is thus a thermokinetic conversion technique which is economical, reliable, effective, environmentally friendly and has improved efficiency.

This improvement in the efficiency of the conversion of waste heat into mechanical energy, and preferentially into electrical or refrigeration energy, is firstly obtained by maximization of the recovery of the available waste heat via heating, by means of heat exchangers on the stream of waste heat, of a heat-transfer fluid FC capturing the high temperatures, complemented by the heating of a working fluid FT in order to capture the lower temperatures. This device with two fluids makes it possible to use up almost all of the valorizable thermal energy.

Indeed, this system benefits from low investment and maintenance costs.

Its simplicity, robustness, relative quietness, ease of installation and implementation, very low-pressure operation (1-10 bar), safety, environmental compliance (no pressure in the vessels, no organic fluid), flexibility (diversity of heat sources), modularity (several jets on one and the same turbine), its high percentage of waste heat valorized by virtue of the 2 fluids, the fact that they produce a cold source of the order of 80° C. allowing additional valorization, its low installation cost and financial profitability are some of the advantages of the system according to the invention.

This optimization of the quantity of waste heat captured is complemented by optimization of the IMA (Injector-Mixer-Accelerator) device for converting thermal energy into kinetic energy, obtained by an adapted proportional ratio between the working fluid FT and the heat-transfer fluid FC, optionally complemented by an acceleration of the working fluid FT upstream of the mixing thereof with the heat-transfer fluid FC. Thus, the inventive principle of the method comprises, for the implementation of step VII, the choice of a ratio Rd of the mass flow of the fluid FT to the total mass flow of the fluid FC and the fluid FT comprised between 1 and 20%, preferably between 3 and 18%, and even more preferentially between 5 and 15%.

According to the invention, the thermal energy to be converted is contained in a waste fluid FF, a portion of the calories of which is firstly transferred to FC (step II), and another portion of the calories of which is then transferred to FT for heating thereof, and preferably for vaporization thereof (steps V and VI).

According to a beneficial embodiment of the invention, the temperature of FF on leaving the FC and FT heat exchangers can be advantageously adapted, before FF is drained to the outside.

In fact, when FF has been loaded with solid particles, FF is drained to the outside, preferably after having undergone a treatment for extraction of these solid particles by filtration, which requires a maximum temperature of FF, so as not to degrade the filters (typically <200° C.).

By virtue of using 2 fluids FT and FC heated directly by the waste fluid FF, the final temperature of the FF is adapted to the filtration constraints, if any, before it is drained to the outside, and/or to the corrosion constraints, as it is possible to dimension the heat exchangers utilized in this method optimally and in particular the temperature of FF on leaving the FF/FT exchanger for heating FT.

According to a beneficial possibility of the invention, the temperature of the fluid FF at the end of steps II, V or VI is composed between 100 and 200° C. and even more preferentially between 180° C. and 200° C.

These temperature values for FF in the method increase the compatibility thereof with a wide range of industrial processes generating waste heat.

Advantageously, during step VII, injection of the stream $f^{f}$ of the working fluid FT into an injection container of the IMA is carried out at a velocity comprised between 40 and 300 m/s, preferably between 50 and 150 m/s and even more preferentially between 60 and 100 m/s.

During step VIII, the stream $f^{f}$ is preferably accelerated and expanded in at least one chamber having a suitable profile, preferably in a flow nozzle.

In a noteworthy variant, before step VIII, the stream $f^{f}$ undergoes, during at least one step ($VIII^{0}$), a pre-acceleration by expansion, preferably quasi-isothermal or polytropic, in at least one chamber having a suitable profile, preferably in a flow nozzle; this step ($VIII^{0}$) advantageously being implemented in the same chamber with suitable profile as that of step (VIII).

According to another innovative arrangement of the method according to the invention, FT is an aqueous liquid, preferably selected from the group comprising—ideally constituted by—water, glycerol and mixtures thereof. Moreover, FC is selected from the vegetable or mineral oils, preferably from oils that are immiscible in water and/or have a temperature at which glazing appears that is above or equal to 200° C., preferably 300° C., and even more preferentially from the vegetable oils; FC ideally being selected from the group comprising—ideally composed of—castor oil and/or olive oil.

According to a preferred characteristic of the invention, the waste fluid FF initially has a temperature above or equal to 200° C. and preferentially above or equal to 300° C., and/or is selected from the gaseous fluids and, even more preferentially, from the group comprising—ideally composed of—hot air, steam, engine exhaust gases, fumes, in particular industrial fumes, flame heat and heat from dryers, or from the liquid fluids (e.g. as is the case in solar concentration installations).

This relates in particular to waste incinerators, installations for the production of heat from biomass, industries such as steelworks, cement works, glass works, as well as heat engines, in particular electricity generators.

The method according to the invention is distinguished in that it implements at least one of the following characteristics:

C1. the operating pressure $Pf^{c0}$ (in bar) of the stream $f^{c0}$ before spraying in step III and after compression of the stream $f^{c0}$ of FC in step XII is such that—in an increasing order of preference:
$3 \leq Pf^{c0} \leq 30$; $5 \leq Pf^{c0} \leq 25$; $10 \leq Pf^{c0} \leq 15$ C2. the operating pressure $Pf^{f}$ (in bar) of the stream $f^{f}$ before spraying during step VII and after compression of the stream $f^{f00}$ of FC in step XIV is such that—in an increasing order of preference:
$3 \leq Pf^{f} \leq 30$; $5 \leq Pf^{f} \leq 25$; $10 \leq Pf^{f} \leq 15$ C3. $Pf^{c0}$ and $Pf^{f}$ are identical or different, preferably identical;

C4. the pressure $Pf^{c1/t}$ of the stream $f^{c1/t}$ after step IX of conversion of the kinetic energy into mechanical energy, in bar and in an increasing order of preference, is such that:
$Pf^{c1/t}2$; $0.3 \leq Pf^{c1/t} \leq 1.5$; of the order of 1 bar (atmospheric pressure).

Advantageously, the size of the droplets of FC making up the fragmented stream generated in step (III) is comprised between 100 and 600 μm, preferably between 200 and 400 μm.

In an effective variant of the invention, it is ensured that the expansion of the stream $f^{f}$ in the container of the IMA also receiving the fragmented stream $f^{c1}$ of fluid FC brings about an acceleration effect (sometimes called jet pump effect) caused by a driving stream, namely the stream $f^{f}$ of FT, on an aspirated stream, namely the stream $f^{c1}$ of FC.

In another aspect thereof, a subject of the present invention is a simple and effective device, in particular for implementing the method according to the invention, characterized in that it comprises at least one FT circulation loop and at least one FC circulation loop, these two loops having in common:

i. at least one Injector-Mixer-Accelerator (IMA) in which the stream $f^{c0}$ and the stream $f^{f}$ are intended to be injected/mixed/accelerated;

ii. at least one converter of the accelerated stream $f^{c1/t}$ into mechanical energy;

iii. optionally, at least one converter of this mechanical energy into electrical energy and/or refrigerating energy;

iv. at least one separator of FT and FC;

the FT circulation loop including at least one heat exchanger between FT (step V, or VI) and FF, at least one condenser of FT and at least one pump for circulating FT in this loop;

the FC circulation loop including a heat exchanger between FC (step II) and FF, and at least one pump for circulating FC in this loop.

Preferably, the IMA comprises at least one jet mixer of the fragmented stream $f^{c0}$ and the stream $f^{f}$ in the form of vapour.

In order to further increase the kinetic energy of the stream producing mechanical movement, the IMA advantageously comprises at least one acceleration flow nozzle connected to the outlet of the mixer or mixers.

Preferably, the converter of the accelerated stream $f^{c1/t}$ into mechanical energy is constituted by at least one turbine, preferably an impulse turbine.

In a beneficial characteristic of the invention:

the converter of mechanical energy into electrical energy is constituted by at least one alternator and/or at least one generator, or the converter of mechanical energy into refrigerating energy is constituted by at least one refrigeration machine comprising at least one compressor including at least one shaft capable of being driven in rotation by a source of mechanical energy.

For example, this converter of mechanical energy into refrigerating energy is constituted by at least one direct drive of the shaft of the compressor of the refrigeration machine.

In an embodiment, the mixer is a jet mixer comprising:

at least one fragmenter of the stream $f^{c0}$ in the form of droplets, said fragmenter including at least one jet, preferentially several, in order to minimize the pressure drops in the stream $f^{c0}$;

at least one chamber for mixing the stream $f^{c0}$ after fractionation and the stream $f^{r}$ in the form of water and/or vapour, this mixing chamber converging in the direction of the streams FT and FC;

at least one pipe for intake of FT into the mixing chamber;

at least one feed line for intake of FC into the mixing chamber;

the mixing chamber including an outlet placed at the convergence point thereof, this outlet opening out into at least one acceleration pipe;

the pipe for intake of FT comprising an internal segment axial with respect to the mixing chamber, this axial internal segment being equipped with at least one end jet for discharge of FT, which includes an FT outlet aperture placed in the vicinity of the end part that has the smallest dimension of the convergent mixing chamber;

the feed line for intake of FC communicating with a plurality of jets for discharge of FC that are distributed over the circumference of the axial internal segment for intake of FT, which includes FC outlet apertures upstream of the FT outlet aperture;

the axial internal segment of the pipe for intake of FT being preferably equipped with an acceleration element, advantageously formed by a venturi.

Definitions

Throughout the present disclosure, any singular denotes singular or plural.

The definitions given below by way of example can serve for the interpretation of the present disclosure;

"fluid": liquid and/or gaseous body

"waste fluid FP": fluid carrying the waste heat intended for conversion into mechanical energy "working fluid FT": fluid at least partially vaporizable by means of the calories of thermal energy to be converted and originating from the waste fluid FF "vapour": gaseous state of the fluid "heat-transfer fluid FC": liquid fluid capable of absorbing the calories of thermal energy to be converted and originating from the waste fluid FF, without passing fully into the gaseous state;

"approximately" or "substantially" means plus or minus 10%, or plus or minus 5%, with reference to the unit of measurement used;

"comprised between Z1 and Z2" means that one and/or the other of the boundaries Z1, Z2 is included, or not, in the range [Z1, Z2];

"immiscible in water" means under the temperature and pressure conditions which are those of the method according to the invention.

The "temperature at which glazing appears" is the temperature from which there is a change in the viscosity characteristics of the oil, in particular a marked increase in viscosity.

DETAILED DESCRIPTION OF THE INVENTION

This description is given with reference to the attached figures, in which.

METHOD

Preferred Mode of Implementation of the Method According to the Invention

Figure 1:
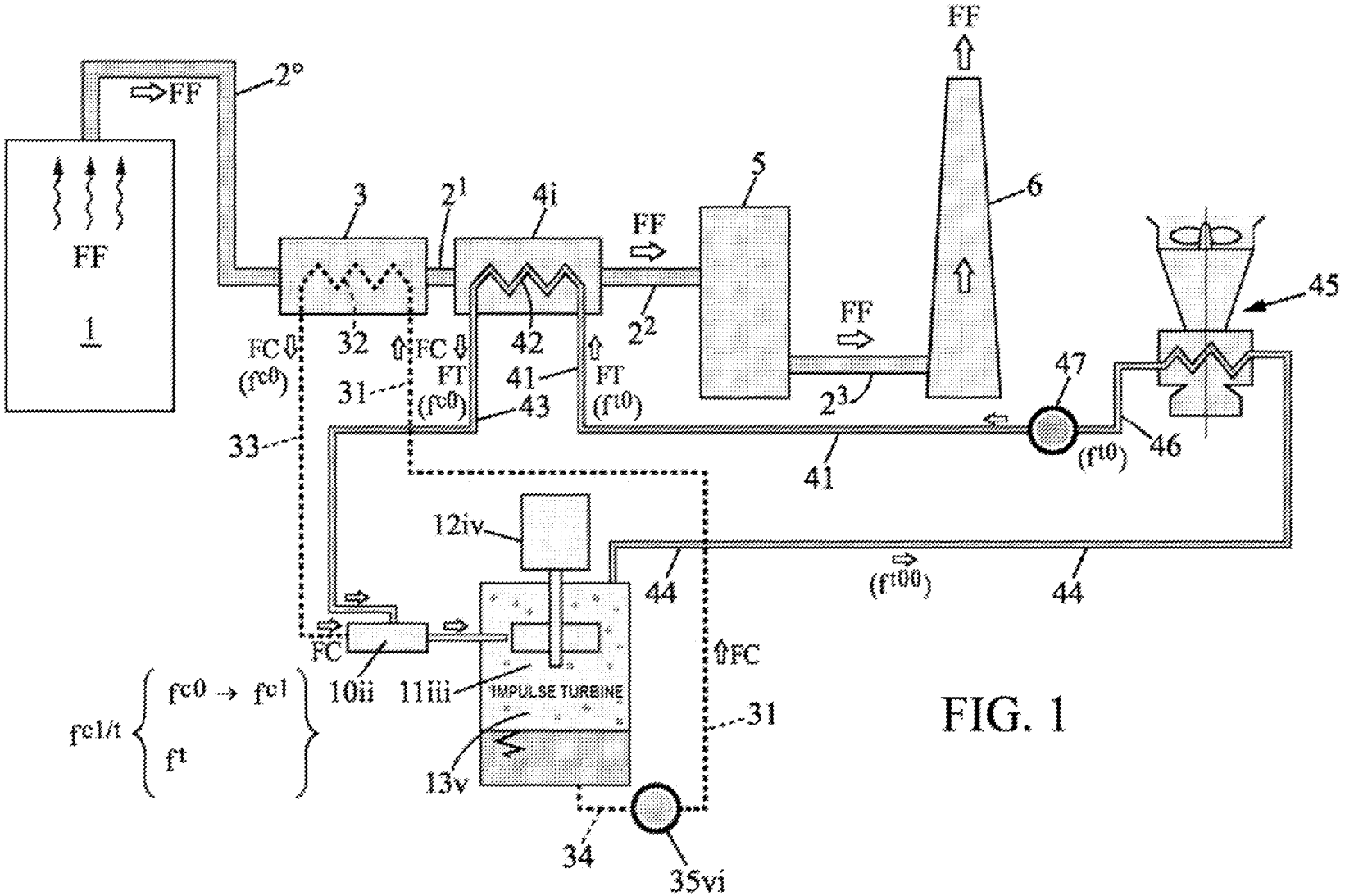
FIG. 1 is a block diagram of the system according to the invention, comprising the method with the modes of operation thereof and the device with the constitutive elements thereof.

The attached FIG. 1 shows diagrammatically the principle and the means of the system according to the invention for converting thermal energy into mechanical, then electrical energy.

Block 1 symbolizes a source of waste heat contained in a waste fluid (FF). This can be for example from an industrial process that emits fumes (FF).

FF (temperature $T^0$) is conveyed by a feed line $\mathbf{2}^0$ through a first exchanger 3*i*, then by a feed line $\mathbf{2}^1$ (FF at a temperature $T^1$) through a $2^{nd}$ exchanger 4*i* in series with the exchanger 3*i*. On leaving the exchanger 4*i*, FF (temperature $T^2$) is brought via a feed line $\mathbf{2}^2$ into an installation for the treatment of fumes FF, symbolized by the block 5. This treatment is, for example, a filtration carried out by means of a bag filter.

Cleared of at least a part of the solid elements, FF is drained via the feed line $\mathbf{2}^3$ to a chimney 6, which releases FF into the ambient air.

The device symbolized in FIG. 1 further includes an injector-mixer accelerator (IMA) 10*ii* producing a mixed and accelerated two-phase stream $f^{c1/t}$, a converter 11*iii* of the kinetic energy of the mixed and accelerated two-phase stream $f^{c1/t}$ into mechanical energy, and a converter 12*iv* of this mechanical energy into electrical energy. The converter 11*iii* is for example an impulse turbine of the Pelton type and the converter 12*iv* is an electric generator.

According to the invention, a fluid FC circulation loop and a fluid FT circulation loop are provided.

The FC loop comprises:

the heat exchanger 3*i;* a feed line 31 for feeding FC into the exchanger 3*i;* a coil 32, where calories are transferred from FF to FC (by way of alternative to the coil, it is possible to utilize an exchanger operating according to another technology, for example fire tube, plate heat exchanger, etc.);

a feed line 33 for transferring FC from the exchanger 3*i* to the IMA 10*ii;* the IMA 10*ii;* the turbine 11*iii;* the generator 12*iv;* a separator of FC and FT comprising a vessel 13*v* and placed at the outlet of the turbine 11*iii;* a feed line 34 for recovering/recycling FC, connected to the separation vessel 13*v;* a pump 35 for circulating FC, this pump 35 being connected, on the one hand, to the separation vessel 13*v* by the feed line 34 and, on the ether hand, to the exchanger 3*i* by the feed line 31.

The FT loop comprises:

the heat exchanger 4*i;* a feed line 41 for feeding FT into the exchanger 4*i;* a coil 42, where calories are transferred from FF to FC (by way of alternative to the coil, it is possible to utilize an exchanger operating according to another technology, for example fire tube, plate heat exchanger, etc.);

location of the transfer of calories from FF to FT;

a feed line 43 for transferring FT from the exchanger 4*i* to the IMA 10*ii;* the IMA 10*ii;* the turbine 11*iii;* the generator 12*iv;* a separator 13*v* of FC and FT, at the outlet of the turbine 11*iii;* a feed line 44 for recovering/recycling vapour FT, connected to the separator 3*v;* a condenser 45 of FT;

a feed line 46 for collecting liquid FT at he outlet from the condenser 45;

a pump 47 for circulating FT, this pump 47 being connected, on the one hand, to the condenser 45 by the feed line 46 and, on the other hand, to the exchanger 4*i* by the feed line 41.

FT is advantageously selected from the group comprising: water, glycerol, and mixtures thereof.

FC is advantageously selected from the vegetable or mineral oils, immiscible in water, for example castor oil and/or olive oil.

The waste fluid FF is constituted e.g. by fumes.

Figure 2A:
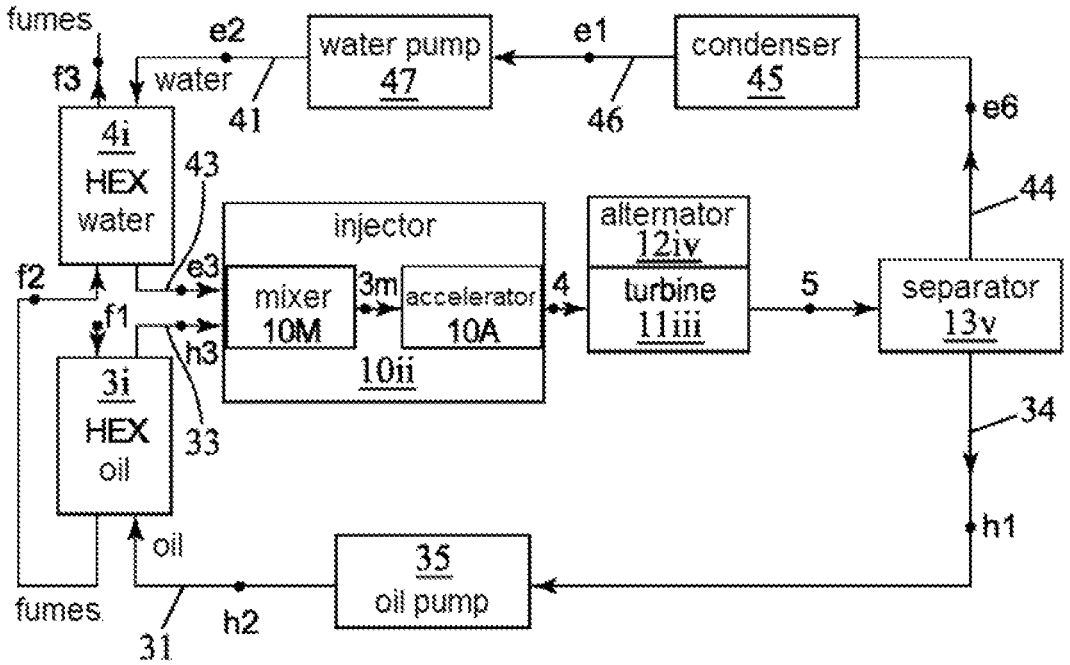
FIG. 2A is a diagram of the system according to the invention, showing the streams of working fluid FT and heat-transfer fluid FC at different points of the device and at different moments in the method.
Figure 2B:
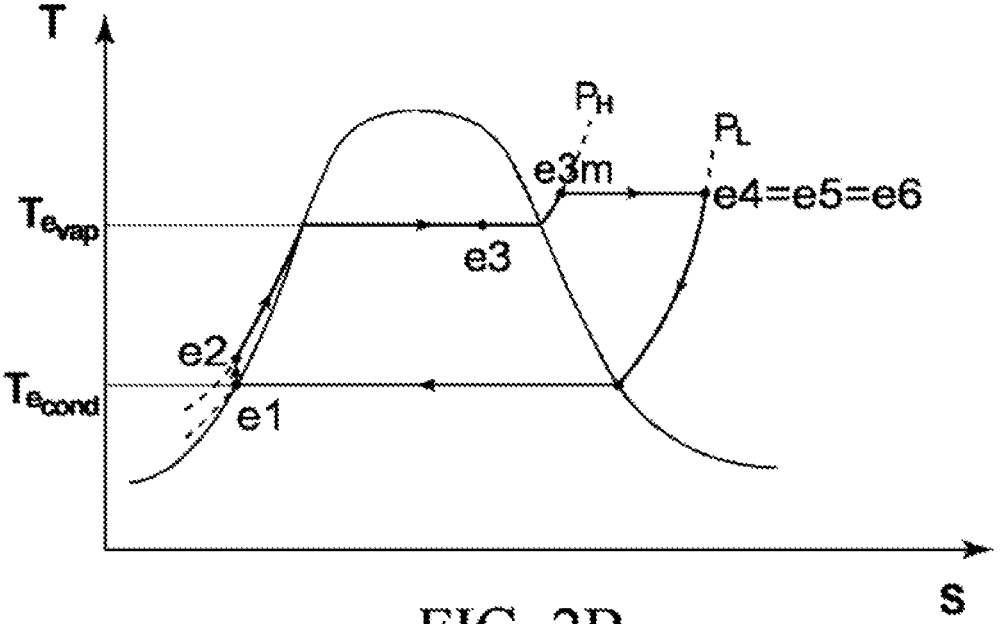
FIG. 2B is an entropy diagram of the temperature T of the working fluid FT as a function of the entropy S, corresponding to the system in FIG. 2A.

In FIGS. 2A and 2B, FT is for example water, labelled with references e1 to e6, FC is for example castor oil, labelled with references h1 to h3, and the fumes FF are labelled with references f1 to f3.

As shown in FIGS. 2A and 2B, in the FC loop, a liquid stream $f^{c0}$ of oil h1, at temperature Th1, for example comprised between 200 and 350° C., and at pressure Ph1, is conveyed in the feed line 34, by virtue of the oil pump 35 for circulating $f^{c0}$, then a liquid stream $f^{c0}$ of oil h2 at a pressure Ph2 greater than Ph1 reaches the oil inlet of the fumes f1/oil h2 heat exchanger 3*i*, via the feed line 31.

The fumes f1 enter the exchanger via another inlet, and preferably against the flow of the liquid stream $f^{c0}$.

The operating pressure $Pf^{c0}$ (in bar) of the stream $f^{c0}$ before spraying in step III and after compression of the stream $f^{c0}$ of FC in step XII is for example comprised between 10 and 20 bar.

The stream $f^{c0}$ of oil h3 heated in step (II) is collected on leaving the exchanger 3*i* via the feed line 33, at temperature Th3>Th1 & Th2, for example comprised between 200 and 350° C., then enters the IMA 10*ii.*

The velocity V of the stream $f^{c0}$ is, for example, comprised between 10 and 20 m/s.

The IMA 10*ii* comprises a fragmenter that converts this liquid stream $f^{c0}$ of oil h3 into a mist of droplets h3. The size of these droplets is for example comprised between 200 and 400 μm.

As shown in FIGS. 2A and 2B, in the FT loop, a liquid stream $f^{t0}$ of water e1, at a temperature below the condensation temperature $Te_{cond}$, is conveyed in the feed line 46, by virtue of the water pump 47 for circulating $f^{t0}$, then a liquid stream $f^{t0}$ of water e2, at a temperature Te2, for example comprised between 40 and 80° C., below $Te_{cond}$, reaches the water inlet of the fumes f2/water e2 heat exchanger 4*i*, via the feed line 41.

The fumes f2 originating from the fumes f1/oil h2 heat exchanger 3*i* enter the exchanger 4*i* via another inlet, and preferably against the flow of the liquid stream $f^{t0}$.

The operating pressure $Pf^{t}$ (in bar) of the stream $f^{t}$ before spraying in step III and after compression of the stream $f^{t00}$ of FC in step XIV is for example identical to $Pf^{c0}$ and comprised between 10 and 20 bar.

The stream $f^{t}$ of water e3 heated in step (V) and at least partially constituted by vapour is collected on leaving the exchanger 4*i* via the feed line 43, at temperature Te3>Te1 & Te2, for example comprised between 180 and 250° C., then enters the IMA 10*ii.*

Te3 advantageously corresponds to the evaporation temperature $Te_{vap}$ of the FT, in this case water.

The velocity V of the vapour stream $f^{t}$ is, for example, comprised between 60 and 100 m/s.

The optional step (VI) of heating the stream $f^{t}$ of water e3, to vaporize it such that the vapour titre thereof is greater than or equal to 0.9, preferably 0.95, is carried out by suitable dimensioning of the exchanger 4*i.*

The part that is common to the FT and FC loops, which comprises the elements of the IMA device 10*ii*, turbine 11*iii*, alternator 12*iv* and separator 13*v*, is then the location of:

step (III) of spraying the stream $f^{c0}$ heated in step (II) in order to generate a fragmented stream $f^{c1}$ of droplets of fluid FC, in this case oil;

step (VII) of injecting the stream $f^{t}$ into at least one container also receiving the stream $f^{c1}$ of fluid FC, in order to form a dual-phase mixed stream $f^{c1/t}$ e3*m;* step (VIII) of accelerating and expanding the dual-phase mixed stream $f^{c1/t}$ e3*m.*

This acceleration increases the velocity of the stream $f^{c1}$ mixed with the stream $f^{t}$ from 10 to 20 m/s, to a velocity $Vf^{c1/t}$ greater than or equal to 100 m/s, for example comprised between 120 and 140 m/s. This dual-phase mixed stream e3*m* becomes the accelerated dual-phase mixed stream $f^{c1/t}$ e4.

During step (VII) for forming a dual-phase mixed stream $f^{c1/t}$, the mass flows of the fluids FT and FC are adjusted so that the ratio Rd=mass flow of FT/Σ mass flows of FT & FC=1 to 20%, for example 10%.

FIG. 2B, which represents the cycle described by the stream $f^{t}$ of vapour e3 between the hot source and the cold source on the axes T temperature and S entropy, shows that the expansion in step (VII) is an isothermal expansion up to the mixing of the stream $f^{t}$ of vapour and the fragmented stream $f^{c1}$, which causes a quasi-isothermal expansion up to the stream $f^{c1/t}$ e3*m.*

This corresponds to step (VIII) of accelerating and expanding the dual-phase mixed stream $f^{c1/t}$.

This assumes that it is ensured by means of the dimensioning of the exchangers 3*i* and 4*i* that Th3 is >than Te3.

The acceleration undergone by the stream $f^{c1/t}$ e3*m* in the IMA 10*ii* produces an accelerated stream $f^{c1/t}$ e4, which is projected onto the blades of the turbine 11*iii*, for example of the Pelton type 9, which can be used as converter of kinetic energy into mechanical energy of rotation transmitted to the alternator 12*iv* that produces electrical energy, all this within the framework of step (IX).

Before the separation in step (X), the stream $f^{c1/t}$ e4, which has now become e5 and from which a large part of the kinetic energy thereof has been released, is characterized by a pressure $Pf^{c1/t}$ approximately equal or equal to atmospheric pressure.

After the separation of step (X), the $f^{c1/t}$ stream e5 divides into a $f^{100}$ stream e6 and a $f^{c0}$ stream h1. $f^{c1/t}$ and $f^{100}$ are recovered separately according to step (XI).

FIG. 2B shows that the temperatures Te3*m*, Te4, Te5 and Te6 are equal to one another and are above the temperature $Te_{vap}$=Te3.

In step (XII), $f^{c0}$ is compressed and the circulation speed thereof is increased.

The stream $f^{00}$ of steam e6 experiences a temperature drop to reach the temperature Te1 of the stream $f^{0}$ at least partially of liquid water e1, during the step of condensation according to step (XIII). In step (XIV), $f^{0}$ is compressed and the circulation speed thereof is increased.

Another Variant of This Preferred Mode of Implementation of the Method According to the Invention According to a beneficial possibility of the invention, it is ensured that the expansion of the stream $f^{v}$ in the container also receiving the stream $f^{c1}$ of mist of fluid FC brings about a jet pump effect caused by a driving stream, namely the stream $f^{v}$ of FT, on an aspirated stream, namely the stream $f^{c1}$ of FC. This jet pump effect is determined by the configuration of the mixing container of the IMA 10*ii*.

Example embodiments of such a configuration are given hereinafter.

"Double Expansion" Variant of this Preferred Mode of Implementation of the Method According to the Invention In this variant, a step ($VIII^{0}$) of pre-accelerating the stream $f^{v}$ is carried out by expansion, preferably polytropic, of the stream $f^{v}$.

Figure 3A:
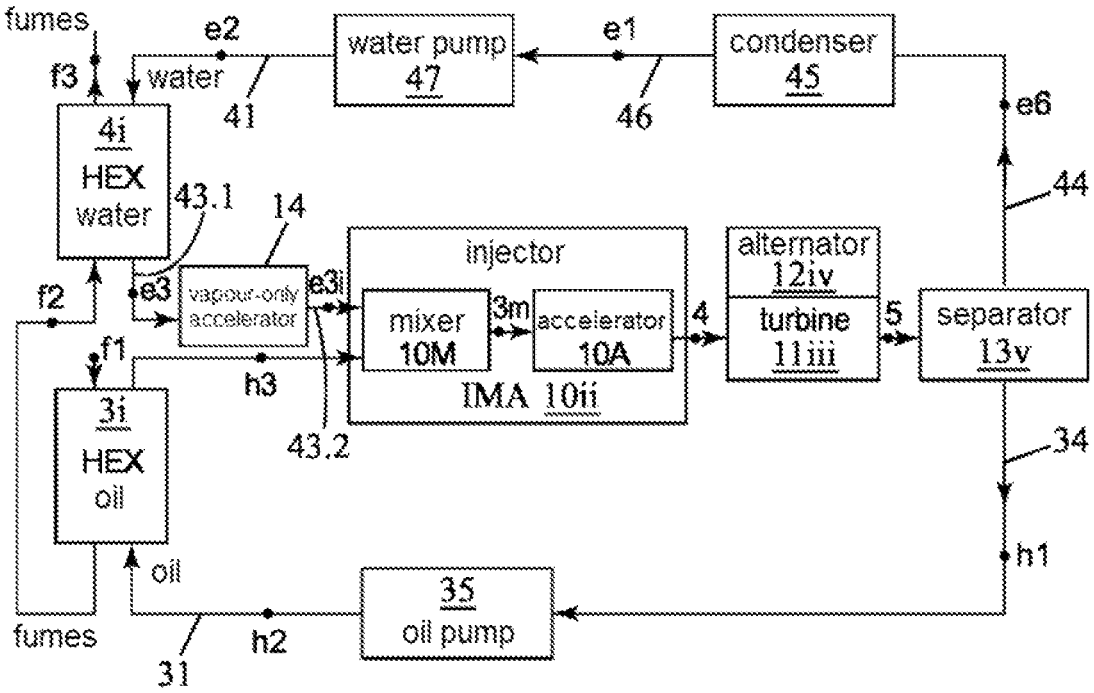
FIG. 3A is a diagram of a double-expansion variant of the system according to the invention, showing the streams of working fluid FT and heat-transfer fluid FC at different points of the device and at different moments in the method.

FIG. 3A shows the diagram of the system according to this "double expansion" variant.

Figure 3B:
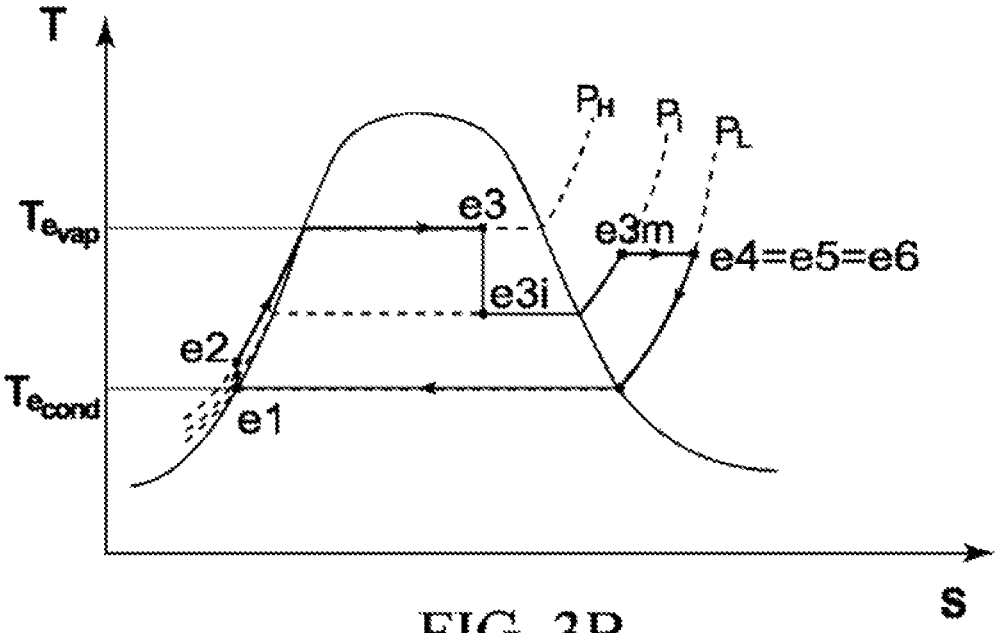
FIG. 3B is an entropy diagram of the temperature T of the working fluid FT as a function of the entropy S, corresponding to the system in FIG. 3A.

This corresponds to the diagram of the system according to the preferred embodiment shown in FIG. 2A, with the difference that the stream $f^{v}$ of steam e3 is introduced, via the feed line 43.1 connected to the outlet of the exchanger 4*i*, into a vapour-only accelerator 14, in which this stream $f^{v}$ undergoes an expansion, preferably polytropic, which makes the temperature drop from Tevap=Te3 for example comprised between 210 and 230° C. to a temperature Te3*i*>Tevap=Te3, for example comprised between 180 and 205° C. (See FIG. 3B).

The stream $f^{v}$ of steam e3*i* is then inlet to the IMA 10*ii* via the feed line 43.2.

The remainder of the system according to this "double expansion" variant corresponds to the description given for the system according to the preferred mode of implementation of the method according to the invention

DEVICE

In another of the aspects thereof, the present invention relates to a device, in particular for implementing the method according to the invention. This device comprises:

Heat Exchanger 3*i*

This is for example a tubular fumes/oil exchanger (reverse-flow).

Heat Exchanger 4*i*

This is for example a fumes/oil plate exchanger (reverse-flow).

Vapour-Only Accelerator 14

This is for example an expansion flow nozzle, the profile of which is optimized for accelerating the velocity of the stream of vapour of FT.

IMA 10*ii*

Preferably, the mixer or mixers 10M comprised in the IMA 10*ii* can be one or more mixer(s) in which the fragmenter is a fragmenter with jets and/or any other device known per se, comprising a suitable fragmenter.

Preferably, the accelerator or accelerators 10A comprised in the IMA 10*ii* can be one or more acceleration flow nozzle(s), dimensioned to be sonic at the neck (Speed of fluid=speed of sound in the medium).

Embodiment with a Jet Mixer

Figure 4:
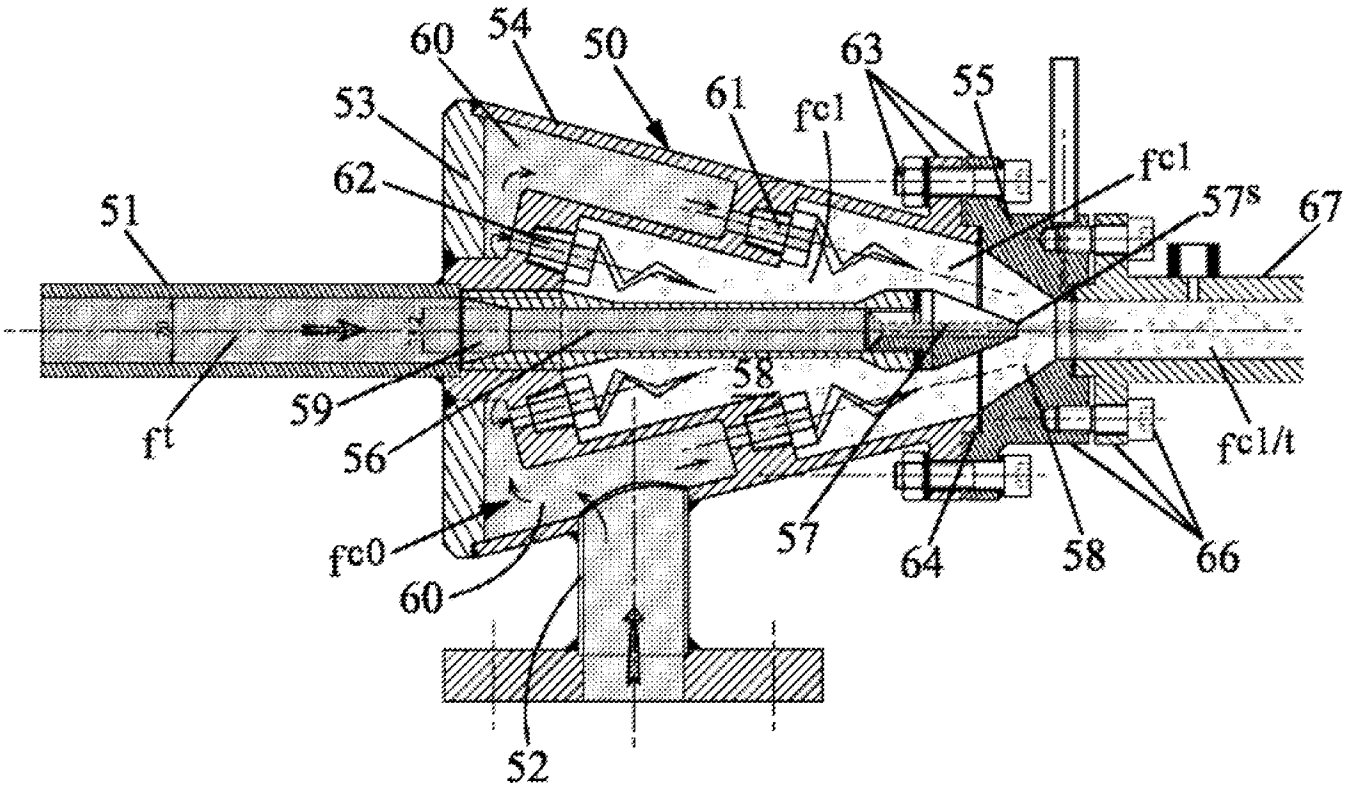
FIG. 4 is a cross section view of the injector-mixer-accelerator (IMA) according to a first embodiment.

As shown in FIG. 4, the jet mixer preferably comprises:

- at least one chamber 50 for mixing the stream $f^{c0}$ in the form of mist and the stream $f^{v}$ in the form of vapour or vapour/water mixture, this mixing chamber 50 converging in the direction of the streams $f^{v}$ and $f^{c1}$;
- at least one pipe 51 for intake of the stream $f^{v}$ of FT into the mixing chamber 50;
- at least one feed line 52 for intake of FC into the mixing chamber 50.

In this example embodiment, the mixing chamber 50 has a generally ogival shape, provided with an upstream wall 53, a longitudinal wall 54, and a converging downstream terminal part 55. The upstream wall 53 is connected to the pipe 51 for intake of FT into the inside of the mixing chamber 50. A flow nozzle holder 56 connects the intake pipe 51 to a terminal flow nozzle 57 for discharge of the stream $f^{v}$ of vapour e3*i* into the container 58 of the mixing chamber 50. In its terminal part the flow nozzle holder 56 comprises a flow nozzle 57 making it possible to carry out step (VIII) of accelerating and expanding, preferably quasi-isothermally or by default polytropically, the stream $f^{v}$ of vapour e3 (FIG. 3A) so as to obtain the discharged stream $f^{v}$ of vapour e3*i*.

The flow nozzle holder 56 is an axial internal segment with respect to the mixing chamber. The terminal flow nozzle 57 for discharge of FT includes an outlet aperture $57^{s}$ for the stream $f^{v}$ of vapour e3, placed in the vicinity of the end part that has the smallest dimension of the convergent ogival chamber 50.

The feed line 52 for intake of the stream $f^{c0}$ of FC into the mixing chamber 50 extends in an orthogonal direction with respect to the pipe 51 for intake of the stream $f^{v}$ of FT. This feed line 52 opens out into a circular pre-chamber 60 situated in the upstream part of the ogival chamber 50. This pre-chamber 60 distributes the stream $f^{c0}$ of FC into a set of peripheral jets 61, 62, distributed evenly around the flow nozzle holder 56, on 2 levels, a central upstream level: jets 62, and a peripheral downstream level: jets 61. These jets 61, 62, the FC outlet apertures of which are upstream of the outlet aperture $57^{s}$ of the stream $f^{v}$ of FT, produce the mist of droplets of FC (stream $f^{c1}$) in the container 58 of the mixing chamber 50.

The convergent downstream terminal part 55 of the mixing chamber 50 is firmly fixed to the longitudinal wall 54 of this mixing chamber 50, by means of an upstream system of flanges and bolts denoted by the general reference 63 in FIG. 4. A circular seal 64 is placed between this downstream terminal part 55 and the longitudinal wall 54. Another downstream system 66 of flanges and bolts makes it possible to firmly fix the downstream terminal part 55 of the ogival chamber 50 to an acceleration pipe 67. This latter is constituted by a flow nozzle (only the upstream part of which is shown in FIG. 4) and collects the dual-phase mixed stream $f^{c1/t}$ (referenced e3*m* in FIG. 3A) in order to subject it to an acceleration.

The jets 61 and 62, which are for example, in this case, those which include a spiral ("corkscrew") end part.

The flow nozzle holder 56, with an upstream restriction 59, and the acceleration flow nozzle 67 are also components known per se and suitable for carrying out the function of acceleration of vapour fluid or dual-phase oil/vapour fluid.

In a noteworthy characteristic of the invention, the end of the outlet aperture 57$^s$ of the terminal discharge flow nozzle 57 is placed at a distance d from the upstream terminal part of the inlet of the acceleration pipe 67 of diameter D, such that: D≤d≤3D, preferably 1.5D≤d≤2.5D.

In another noteworthy characteristic of the invention, the convergent ogival structure of the mixing chamber 50, the relative positioning of the flow nozzle 57 downstream of the jets 61/62 makes it possible to generate a jet pump effect by means of which the stream $f^r$ of FT is a driving fluid which drives the aspirated fluid constituted by the mist of droplets of fluid FC (oil):stream $f^{c1}$.

This jet pump effect makes it possible to reduce the pressure of the fluid FC on leaving the pump 35, and thus to reduce the power consumption.

Kinetic Energy/Mechanical Energy Converter 11*iii*

This is for example a Pelton-type turbine, such as described in PCT patent application WO2012/089940A2, in particular in FIGS. 3 and 4 and in the corresponding parts of the description. This example kinetic energy converter 11*iii* is described again hereinafter with reference to FIG. 5. The kinetic energy converter 11*iii* comprises a heat-insulated container 150 formed by two convex half-shells 152 of elliptic shape advantageously welded onto two flanges 154. Welding of the two half-shells 152 forms a sealed container 150 of substantially vertical axis B perpendicular to the axis A of the injector 151. The bottom of container 150 forms for example the reservoir of heat-transfer fluid FC (oil) where the latter is collected after it has passed into converter 11*iii*, as will be described below.

A tank 155 is arranged inside the container 150. This tank 155 is formed of a bottom 156 substantially in the shape of a truncated cone or a funnel and a wall 157 of substantially cylindrical shape extending from the bottom 156; the bottom 156 and the wall 157 extending along the axis B. A cylindrical impulse wheel 158 is mounted rotatably on the tank 155 by means of a shaft 159 extending along the substantially vertical axis B. The impulse wheel 158 is arranged facing the injector 20 so that the jet injected by the latter drives the impulse wheel 158 and the shaft 159 rotatably so as to convert the axial kinetic energy of the jet into rotational kinetic energy of the shaft 159. The impulse wheel 158 is arranged in the container 150.

The impulse wheel 158 comprises a plurality of blades 160 extending substantially radially and having a concave shape. The concavity 161 of the blades 160 is turned towards the injector 151 so that the injected jet originating from the injector reaches said concavities 161 and drives the rotation of the wheel 158. The concavity of the blades 160 has an asymmetric shape with respect to an axis C passing through the bottom 162 of the concavities and substantially perpendicular to these concavities, i.e. substantially parallel to the axis A situated above the axis C. For each blade 160 this asymmetry determines an upper part 163 extending above the axis C and a lower part 164 extending below the axis C. The upper part 163 and the lower part 164 have different radii of curvature and lengths. In particular, the radius of curvature of the lower part 164 is greater than the radius of curvature of the upper part 163, while the length of the lower part 164 is greater than the length of the upper part 163.

The injector 151 is arranged to inject the jet onto the upper part 163 of the blades 160. The position of injection of the jet onto the blades 160 as well as the particular shape of the latter make it possible to lengthen the path of the jet in the blades 160 and to improve the stratification of this jet on leaving the blades, which makes it possible then to separate the heat-transfer fluid and the high-temperature gas. The angle at which the jet leaves the blades 160, i.e. the angle formed between the tangent to the end of the lower part of the blade and the horizontal axis C, is substantially comprised between 8° and 12°, so that on leaving the blade 160 the jet has a much greater kinetic energy than in a conventional Pelton turbine, where the outlet angle of the blades is substantially comprised between 4° and 8°. This kinetic energy increase makes it possible to improve the separation of the heat-transfer fluid and the high-temperature gas.

Separator 13*v*=Deflector 165

On leaving the blade 160, the jet enters a deflector 165 extending below the blades 160 and arranged in order to reorient the fluid received towards the wall 157 of the tank 155. The deflector 165 makes it possible to stratify the mixture of the heat-transfer fluid and the high-temperature gas, as shown in FIG. 4 of WO2012/089940A2. In particular the deflector 165, more particularly shown in FIG. 3 of WO2012/089940A2, has a shape arranged to recover the mixture leaving the wheel 158 in a substantially vertical direction and to continuously reorient this mixture in a substantially horizontal direction, as shown in FIG. 4 of WO2012/089940A2, so that it leaves the deflector 165 tangentially to the wall 157 of the tank 155, i.e. the mixture leaves the deflector 165 by following the wall 157 of the tank 155. To this end, the deflector 165 comprises at least one inlet opening 166 for the mixture of heat-transfer fluid and high-temperature gas leaving the impulse wheel 158, said opening extending in a plane substantially perpendicular to the axis B of the wheel 158, i.e. a substantially horizontal plane, and an outlet opening 167 for the mixture, said opening extending in the vicinity of the wall 157 of the tank 155 and in a substantially vertical plane. The inlet opening 166 and the outlet opening 167 are connected to one another by an enclosure 168 having a curved shape, as shown in FIG. 3 of WO2012/089940A2. According to the particular embodiment shown in FIG. 3 of WO2012/089940A2, inner walls extend inside the enclosure 168, substantially parallel to the latter so as to define channels for circulation of the mixture in the enclosure and to separate several inlet openings and a corresponding number of outlet openings.

Separation of the heat-transfer fluid and the high-temperature gas begins in the blades 160 by centrifugation of the mixture due to the shape of the blades 160. When passing into the deflector 165, the remainder of the mixture is stratified and passes continuously from a flow in the outlet direction of the wheel 158 to a flow tangential to the wall 157 of the tank 155, as shown in FIG. 4 of WO2012/089940A2. This tangential flow causes centrifugation of the mixture on account of the cylindrical shape of the wall 157, which makes it possible to complete the separation of the high-temperature gas and the heat-transfer fluid by cyclone effect. Thus, separation of the mixture is performed optimally so that the heat-transfer fluid and the high-temperature gas are separated to a level of more than 98%. The fact of providing an impulse wheel 158 rotatable about a substantially vertical axis B makes it possible to create the cyclone effect on the wall of the tank, due to the fact that it is possible to place a deflector 165 to reorient the mixture suitably.

According to an embodiment, the energy converter comprises several injectors 151, for example six, as in a conventional Pelton turbine, and an equal number of deflectors 165.

Once separated, the heat-transfer fluid is driven to the bottom of the tank 155 by gravity, whereas the high-temperature gas formed by the steam moves to the top of the container 150. The upper part of the container 150 comprises means 169 for recovering the stream $f^{r}$ of high-temperature vapour separated from the heat-transfer fluid FC. The high-temperature vapour stream $f^{r}$ leaves the container via these recovery means 169 and circulates in the remainder of the installation as will be described below.

The bottom 156 of the tank 155 comprises means 170 for recovering the heat-transfer fluid, so that the latter passes into the reservoir 171 when leaving the tank 157. These recovery means 170 are for example formed by flow holes made in the bottom 156 of the tank 155 and communicating between the tank 155 and the bottom of the container 150.

The recovered heat-transfer fluid serves in particular to lubricate at least one plain thrust bearing 70 of hydrodynamic type by means of which the shaft 159 of the impulse wheel 158 is mounted rotatably the bottom 156 of the tank 155. The plain thrust bearing 172 in fact bathes in the heat-transfer fluid recovered by the recovery means 173. Such a bearing 172 makes it possible to ensure the rotation of the shaft 159 at high speed in a high-temperature environment with a long lifetime, unlike conventional ball bearings. Moreover, installation of the bearing 172 inside the container 150 makes it possible to avoid any sealing problems and prevent leakage of the heat-transfer fluid, which could be hazardous. According to the embodiment shown in FIG. 7, the converter 11*iii* comprises two plain thrust bearings 172. In the reservoir 171, a circulating pump 173 for heat-transfer fluid FC (oil), for example of the volumetric type, is mounted on the shaft 159 by means of a homokinetic seal 174. This pump is connected to an outlet pipe 175 connecting the inside of the container 150 to the outside and making it possible to circulate the heat-transfer fluid to the remainder of the installation 1. The circulating pump 72 is thus arranged to aspirate the heat-transfer fluid FC from the reservoir 171 and to inject it into the outlet pipe 175. The circulating pump does not have a drive motor, as actuation thereof is ensured by the rotation of the shaft 159 of the impulse wheel 158 driven by the jet injected by the injector 151

Converter of Mechanical Energy into Electrical Energy: Alternator 12*iv*

Figure 5:
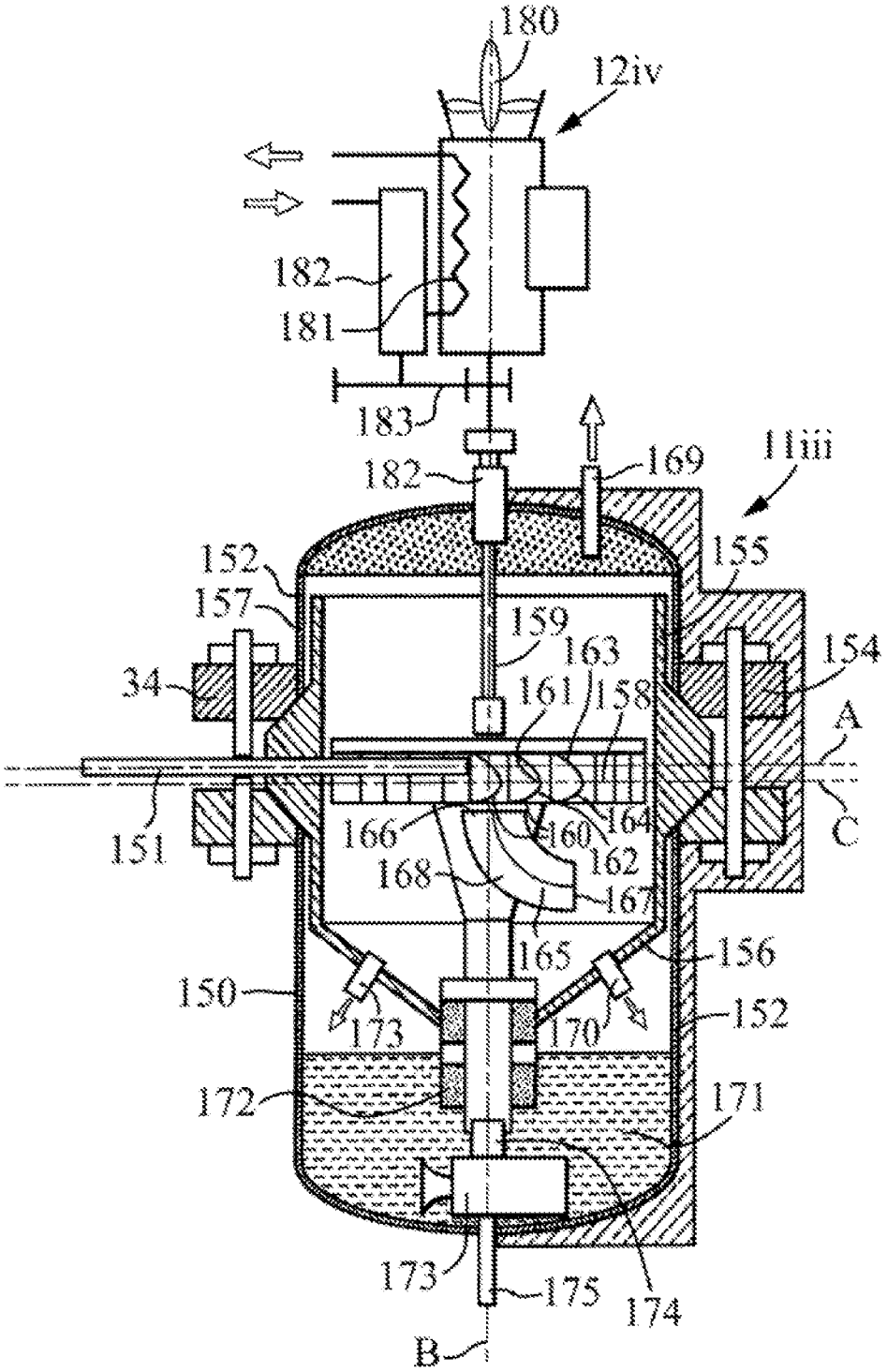
FIG. 5 is a diagrammatic partial cross section view of the turbine and of the alternator of the device shown in FIGS. 1 and 2A.

As shown in FIG. 5, the shaft 159 of the impulse wheel 158 leaves the container 151 via a piston 184 arranged to provide sealing between the inside of the container 151 and the outside of the container 151, for example a Swedish piston. The shaft 159 rotationally drives the rotor of the alternator 12*iv*, advantageously of the permanent magnet type. This alternator 12*iv* makes it possible to convert the kinetic energy of rotation of the shaft 159 into electrical energy. The alternator 12*iv* is cooled, at the level of the air gap thereof, by a fan 180 mounted on the rotor thereof, and by a water circulation pipe, forming the cooling head 181, which encases the stator thereof. The water feeding the cooling head 181 originates from a water supply source and is brought to the jacket by a volumetric pump 182 actuated by the shaft 159 via a reduction gear 183. Thus the pump 108 has no actuating motor. The cooling head 181 serves to cool the alternator 12*iv* and to pre-heat the water, as 30 described above.

Condenser 45

The stream $f^{r}$ of steam collected by the recovery means 169 provided in the container 151 in FIG. 5 is cooled by a condenser 45, in order to be converted into a stream $f^{r0}$ of liquid working fluid FT (water) before being recycled.

This can be for example a condenser of the cooling tower type or an exchanger the secondary coil of which is fed with water at a temperature lower than 60° C. (river, canal, etc).

The invention claimed is:

1. A method for converting thermal energy, contained in an at least partially gaseous waste fluid FF, into mechanical energy, said method comprising steps of:

I. utilizing a stream $f^{c0}$ of an at least partially liquid heat-transfer fluid FC;

II. transferring thermal energy originating from the waste fluid FF to the stream $f^{c0}$;

III. generating a fragmented stream $f^{c1}$ of the heat-transfer fluid FC by spraying the stream $f^{c0}$ heated in step II;

IV. in parallel to step III utilizing an at least partially liquid stream $f^{r0}$ of a working fluid FT;

transferring thermal energy originating from the waste fluid FF to the stream $f^{r0}$ to generate a stream $f^{r}$ having a temperature higher than a temperature of the stream $f^{r0}$, wherein the working fluid FT in the stream $f^{r}$ is i. in liquid phase;

ii. in liquid phase and in vapour phase;

iii. in saturated vapour phase; or iv. in superheated vapour phase;

V. heating the stream $f^{r}$ to vaporize if the working fluid FT in the stream $f^{r}$ is not in the saturated vapour phase such that a vapour titre thereof is greater than or equals to 0.9;

VI. injecting the stream $f^{r}$ into at least one container also receiving the stream $f^{c1}$ to form a dual-phase mixed stream $f^{c1/t}$, a ratio Rd of a mass flow of the working fluid FT to a total mass flow of the heat transfer fluid FC and the working fluid FT being between 1 and 20%;

VII. accelerating and expanding the stream $f^{c1/t}$;

VIII. converting kinetic energy of the accelerated stream $f^{c1/t}$ into mechanical energy;

IX. separating the working fluid FT and the heat-transfer fluid FC;

X. recovering an at least partially gaseous stream $f^{r00}$ of the working fluid FT and an at least partially liquid stream $f^{c0}$ of the heat-transfer fluid FC;

XI. compressing the stream $f^{c0}$, and increasing circulation speed thereof;

XII. condensing the at least partially gaseous stream $f^{r00}$ to the at least partially liquid stream $f^{r0}$; and XIII. compressing the at least partially liquid stream $f^{c0}$, and increasing circulation speed thereof;

wherein the method further comprises implementation of at least one working fluid FT circulation loop and at least one heat-transfer fluid FC circulation loop, said loops sharing i. at least one Injector-Mixer-Accelerator (IMA) in which the stream $f^{c0}$ and the stream $f^{r}$ are intended to be injected/mixed/accelerated;

ii. at least one turbine to convert the accelerated stream $f^{c1/t}$ into mechanical energy; and iii. at least one separator of the working fluid FT and the heat-transfer fluid FC;

and wherein the at least one working fluid FT circulation loop includes at least one heat exchanger between the working fluid FT and the waste fluid FF, at least one condenser of the working fluid FT, and at least one pump for circulating the working fluid FT in the at least one working fluid FT circulation loop; and the heat-transfer fluid FC circulation loop includes a heat exchanger between the heat transfer fluid FC and the waste fluid FF, and at least one pump for circulating the heat-transfer fluid FC in the heat transfer FC circulation loop.

2. The method according to claim 1, wherein, during step VIII, injection of the stream $f^{r}$ into the at least one container is carried out at a velocity between 40 and 300 m/s.

3. The method of claim 2, wherein injection of the stream $f^{r}$ into the at least one container is carried out at a velocity between 50 and 150 m/s.

4. The method of claim 3, wherein injection of the stream $f^{r}$ into the at least one container is carried out at a velocity between 60 and 100 m/s.

5. The method according to claim 1, wherein expansion of the stream $f^{r}$ in the at least one container also receiving the fragmented stream $f^{c1}$ brings about an effect caused by the stream $f^{r}$ on the stream $f^{c1}$.

6. The method according to claim 1, wherein before step VIII the stream $f^{r}$ undergoes, a pre-acceleration by expansion, in the at least one IMA having a flow nozzle.

7. The method according to claim 1, wherein the working fluid FT is an aqueous liquid, selected from the group consisting of water, glycerol and mixtures thereof, and wherein the heat-transfer fluid FC is selected from oils that are immiscible in water and/or having a temperature at which glazing appears at or above 200° C.

8. The method of claim 7, wherein the heat-transfer fluid FC is selected from oils that are immiscible in water and/or having a temperature at which glazing appears at or above 300° C.

9. The method of claim 7, wherein the heat-transfer fluid FC is selected from vegetable oils.

10. The method of claim 9, wherein the heat-transfer fluid FC is castor oil or olive oil.

11. The method according to claim 1, wherein the waste fluid FF initially has a temperature above 200° C. and/or is selected from gaseous fluids.

12. The method according to claim 11, wherein the waste fluid FF initially has a temperature above 300° C.

13. The method according to claim 1, comprising at least one of the following characteristics:

C1.an operating pressure $Pf^{c0}$ of the stream $f^{c0}$ before spraying in step III and after compression of the stream $f^{c0}$ in step XII is such that:

$$3 \leq Pf^{c0} \leq 30;$$

C2. an operating pressure $Pf^{r}$ of the stream $f^{r}$ before injection during step VII and after compression of the stream $f^{r00}$ in step XIV is such that:

$$3 \leq Pf^{r} \leq 30;$$

C3. an operating pressure $Pf^{c0}$ of the stream $f^{c0}$ before spraying in step III and the operating pressure $Pf^{r}$ of the stream ft before injection during step VII are identical or different;

C4. a pressure $Pf^{c1/t}$ of the stream $f^{c1/t}$ after step IX of conversion of the kinetic energy into mechanical energy, such that $Pf^{c1/t} \leq 2$.

14. A device for implementing the method according to claim 1, wherein the device comprises the at least one working fluid FT circulation loop and the at least one heat-transfer FC circulation loop, said loops sharing:

i. the at least one Injector-Mixer-Accelerator (IMA) in which the stream $f^{c0}$ and the stream $f^{r}$ are intended to be injected/mixed/accelerated;

ii. the at least one turbine of the accelerated stream $f^{c1/t}$ into mechanical energy;

iii. the at least one separator of the working fluid FT and the heat-transfer fluid FC; and wherein the working fluid FT circulation loop includes the at least one heat exchanger between the working fluid FT and the waste fluid FF, the at least one condenser of the working fluid FT, and the at least one pump for circulating working fluid FT in the working fluid circulation loop;

the heat-transfer fluid FC circulation loop includes the heat exchanger between the heat transfer fluid FC and the waste fluid FF, and the at least one pump for circulating the heat-transfer fluid FC in the heat transfer FC circulation loop.

15. The device according to claim 14, wherein the at least one IMA comprises at least one jet mixer of the stream $f^{c0}$ and the stream $f^{r}$ in the form of vapour.

16. The device according to claim 15, wherein the at least one jet mixer comprises:

at least one fragmenter of the stream $f^{c0}$ in the form of droplets, said fragmenter including at least one jet, in order to minimize the pressure drop in the stream $f^{c0}$;

at least one mixing chamber for mixing the stream $f^{c0}$ after fractionation and the stream $f^{r}$ in the form of water and/ or vapour, the at least one mixing chamber converging in a direction of streams of the working fluid FT and the heat-transfer fluid FC;

at least one pipe for intake of the working fluid FT into the at least one mixing chamber;

at least one feed line for intake of the heat-transfer fluid FC into the at least one mixing chamber;

wherein the at least one mixing chamber includes an outlet placed at a convergence point thereof, the outlet opening into at least one acceleration pipe;

wherein a pipe for intake of the working fluid FT comprises an axial internal segment with respect to the at least one mixing chamber, the axial internal segment being equipped with at least one end jet for discharge of the working fluid FT, and including a working fluid FT outlet aperture placed in a vicinity of an end part that has the smallest dimension of a convergent mixing chamber;

wherein the at least one feed line communicates with a plurality of jets for discharge of the heat-transfer fluid FC, the plurality of the jets being distributed over a circumference of the axial internal segment including heat-transfer fluid FC outlet apertures upstream of the working fluid FT outlet aperture; the axial internal segment being equipped with an acceleration element.

17. The device of claim 14, wherein the at least one working fluid FT circulation loop and at least one heat-transfer FC circulation loop additionally share at least one electric generator for transforming the mechanical energy into electrical energy and/or refrigerating energy.

18. The method of claim 1, wherein the mechanical energy of the at least one turbine is further converted into electrical energy and/or refrigerating energy.

* * * * *